US005458180A

United States Patent [19]

Landua et al.

[11] Patent Number: 5,458,180

[45] Date of Patent: Oct. 17, 1995

[54] DEVICE AND METHOD OF FILLING CORE-SHOOTING HEADS WITH MOLD-CORE MATERIALS

[75] Inventors: Werner Landua, Mannheim; Reiner Rommel, Brühl, both of Germany

[73] Assignee: Adolf Hottinger Maschinenbau GmbH, Mannheim-Rheinau, Germany

[21] Appl. No.: 185,875

[22] PCT Filed: Feb. 18, 1992

[86] PCT No.: PCT/DE92/00113

§ 371 Date: Jan. 21, 1994

§ 102(e) Date: Jan. 21, 1994

[87] PCT Pub. No.: WO93/04800

PCT Pub. Date: Mar. 18, 1993

[30] Foreign Application Priority Data

Aug. 30, 1991 [DE] Germany ..... 41 28 952.8

[51] Int. Cl.[6] ..... B22C 15/22; B22C 15/23

[52] U.S. Cl. ..... 164/20; 164/21; 164/201

[58] Field of Search ..... 164/19, 20, 21, 164/22, 200, 201

[56] References Cited

FOREIGN PATENT DOCUMENTS

| | | | |
|---|---|---|---|
| 44665 | 3/1990 | Austria . | |
| 0165531 | 12/1985 | European Pat. Off. . | |
| 839247 | 7/1951 | Germany . | |
| 1165812 | 3/1964 | Germany . | |
| 2241507 | 3/1974 | Germany . | |
| 55-97845 | 7/1980 | Japan | 164/201 |
| 58-32542 | 2/1983 | Japan | 164/200 |
| 1-273648 | 11/1989 | Japan | 164/200 |

*Primary Examiner*—J. Reed Batten, Jr.

*Attorney, Agent, or Firm*—Bell, Seltzer, Park & Gibson

[57] ABSTRACT

A storage hopper retains the mold core material and an outlet member is connected below the hopper for discharging the mold core material into the core shooting head. The outlet member is inserted into the core shooting head and is mounted on a vertically adjustable machine frame such that it may be inserted to various depths within the core shooting head and may also be removed. A shutoff device in the form of a rotating shutter closes the outlet member. A frame supports the outlet member and the storage hopper and vertically adjusts both for immersion within the core shooting head. A displacement measuring sensor detects the vertical position of the vertical adjustment members in relation to the machine frame. In the method the storage hopper is filled with mold core material, the outlet member is positioned over the core shooting head, and the outlet member is immersed within the core shooting head. The shutter is then opened to partially fill the core shooting head with the core material to a predetermined filling height corresponding to the lower edge of the outlet member. The outlet member is then closed by rotation of the shutter, and then moved laterally within the core shooting head by rotation of the outlet member about a vertical axis which is offset from the central axis of the outlet member, and the filling operation is repeated.

27 Claims, 2 Drawing Sheets

DEVICE AND METHOD OF FILLING CORE-SHOOTING HEADS WITH MOLD-CORE MATERIALS

FIELD OF THE INVENTION

The invention relates to a device for filling core-shooting heads with mold-core materials, the device comprising an outlet member or pipe for discharging the mold-core material into the core-shooting head, and a shutoff device for closing the outlet member. The invention further relates to a corresponding method of using the device under consideration.

BACKGROUND OF THE INVENTION

In the foundry practice, core-shooting machines have been known for many years. For casting molded components, foundry cores or molds are mostly made in separate parts, combined, and joined to one another to a casting mold. An essential part of the core shooting machines are the so-called core-shooting heads with ejector plates accommodating the shooting nozzles. It has been common practice to fill the mold-core material, in particular core sand, i.e. quartz sand already mixed or coated with binders, into the core-shooting heads under consideration, and thence to blow or shoot it under a very high air pressure through the nozzles arranged in the ejector plate into the respective molds.

In practice, the core shooting heads are filled with core sand almost completely, it further having been common practice to fill the core-shooting heads regardless of the volume of core sand needed in the respective molds. As a result of filling the core-shooting heads to an always considerable extent, the pressure required for the shooting is extremely high. This pressure is normally between four and six bar. This extremely high pressure is required in particular for the reason that a considerable quantity of core sand is present between the shooting nozzles and the source of inflow of the compressed air used for the shooting operation. To accelerate the sand particles through the nozzle, it is necessary to blow the compressed air through the entire volume of sand in the core-shooting head. Added to this is an always uneven distribution of the core sand in the core-shooting heads. As a result, the pressure required for a continuous shooting operation has again to be very high.

Core-shooting under high air pressures which have so far been absolutely necessary, is however extremely problematic in practice, since the sand exiting from the shooting nozzles impacts always upon the walls of the mold to be filled, and has there an extremely abrasive effect. In other words, the shooting nozzles operate in the meaning of a sand blasting gun, so that the core sand exiting under a high pressure damages the mold to be filled successively, or changes same in its geometry. A further disadvantage of core-shooting under high air pressures may be seen in that already when the core sand is shot into the mold, the high air pressures lead to compressions of the core sand in the region of the injection or shooting. Consequently, in particular in the case of complicated geometries, a form-locking filling of the mold is impeded, or at least considerable density gradients develop.

Furthermore, as a result of the high air pressures and the resultant heavy impact of the sand upon the walls of the respective mold, a binder adhering to the sand is downright blown off or separated, and last not least an uneven distribution of sand and binder develops as a result of the density differences between sand and binder. Gases which are liberated at high temperatures from binder concentrations, prevent again a uniform compression or the formation of a flawless core.

Finally, in the known core-shooting practice a serious problem lies in that, regardless of the volumes of cores to be shot, the core-shooting heads are always filled to the same level. As a consequence, it is necessary, even when the dimensions of the cores to be shot are very small, to blast the compressed air required for the shooting through the core sand deposit stored in the core-shooting head, or to accelerate the core sand particles directly adjacent to the shooting nozzles. On the one hand, the large dimensions of the core-shooting heads required for the shooting of large cores, and on the other hand the considerable volume of core sand to be penetrated by the compressed air, however, absolutely necessitate the high pressures previously represented to be extremely disadvantageous.

It is therefore the object of the present invention to describe a device and a method of filling core-shooting heads and mold-core materials, which allow for purposes or reducing the compressed air pressures required for the shooting of cores, to fill the core-shooting head in portions, and yet evenly, with a mold-core material.

SUMMARY OF THE INVENTION

The device of the present invention accomplishes the foregoing and other objects. Accordingly, the initially described device for filling core-shooting heads with mold-core materials is perfected and further developed such that for purposes of immersing into the core-shooting head to be filled, the outlet member or pipe is mounted on a machine frame or the like for vertical movement and can be secured within the range of its vertical mobility in any desired position.

In accordance with the invention it has been recognized, first, that the core-shooting head can be filled always as a function of the volume or the geometry of the core to be shot. Furthermore, a quasi preliminary compression of the mold-core materials to be accelerated by the shooting nozzles is avoided in the core-shooting head in that for filling the latter the outlet member immerses into the core-shooting head, and that thus the mold-core material is carefully filled into the core-shooting head. To this end, the outlet member is supported on a machine frame or an upright or the like for vertical movement, and it can be secured in any desired position within the region of its vertical mobility. In other words, "portions of mold-core material" can be supplied into the core-shooting head in measured quantities, the metering being effected by the shutoff device for closing the outlet member.

Thus, in accordance with the invention, it has been recognized that the core-shooting head needs to be filled always as a function of the core to be shot. As a result of the thus lesser filling capacity of the core-shooting head, it is possible to reduce the pressures required for the acceleration the mold-core or sand particles or for the shooting, from maximally six bar to less than three bar. Besides the low shooting pressure, a minimum time for the passage of the mold-core material or sand is achieved. As a result of the lower shooting pressure both the molds to be filled and the shooting nozzles are effectively protected and, therefore, have a longer service life.

As regards the configuration of the outlet member, it is especially advantageous when same is made tubular. Advantageously, the storage hopper is constructed substantially funnel-shaped, so that when the outlet member directly adjoins the feed hopper, both structural parts form together a kind of funnel with a filling tube. Within the scope of such a configuration, the outlet member is held by the storage hopper, so that it is vertically movable together with the storage hopper.

Likewise however, it would be conceivable to connect the outlet member via a flexible hose or the like with the storage hopper. In such an event, the feed hopper could be arranged stationarily, and only the outlet member would be supported for vertical movement.

The vertical mobility of the outlet member and, possibly, of the storage hopper could occur in a further advantageous manner via a lifting mechanism jointed to the machine frame and operating between the machine frame and the outlet member or storage hopper. This lifting mechanism could have at least one drive and, possibly, vertical guideways or guide elements, so that the drive and the guideways are jointly responsible for the lifting motion of the outlet member or the storage hopper. The drive itself could be designed and constructed as a cylinder-piston arrangement, so that the provision of the latter would already furnish a guideway, namely, the guidance of the piston in the cylinder.

In particular for a loadable arrangement of the storage hopper or the outlet member above the core-shooting head to be filled, primarily in the instance of a considerably filled storage hopper, it is of quite a special advantage, when at least two, preferably three drives or cylinder-piston arrangements are provided. Separate guideways may then become unnecessary.

To be able to perform indeed a controlled filling of the core-shooting head, i.e., in the case of predetermined core dimensions to thus allow to fill a corresponding quantity of core sand into the core-shooting head, the vertical movement of the outlet member and, possibly, of the storage hopper is adapted for detection by a displacement measuring sensor. The latter may be a displacement measuring sensor which on the one hand is attached to the machine frame, and on the other hand operatively connected via a linkage with the storage hopper or the outlet member. The arrangement may also be made in reversed order. Essential however is that the displacement measuring sensor detects the lifting movement of the piston of the piston-cylinder arrangement relative to the machine frame. The displacement measuring sensor serving to detect the relative movement between the outlet member and the machine frame and, thus, also relative to the core-shooting head, may be noncontacting in a further advantageous manner and as an alternative to the above-described configuration. In this instance, the displacement measuring sensor could operate by induction, capacitance or the eddy-current principle. Likewise, a photooptical detection would be conceivable. In a particularly advantageous manner, the displacement measuring sensor could operate by means of ultrasound, and be provided within the cylinder-piston arrangement, for example, as an integral part thereof causing the stroke of the outlet member, so that the movement of the piston is detected directly.

In particular, with respect to a largely even distribution of the core sands inside the core-shooting head, it will be of quite a special advantage, when the outlet member and, possibly, the storage hopper is or are rotatable about an axis of rotation substantially in horizontal direction. This rotatability is preferably by 360°, i.e., the outlet member and, possibly, the storage hopper can be pivoted or rotated endlessly about an axis of rotation. The axis of rotation extends substantially parallel to the outlet member outside thereof. Furthermore, it is essential that the outlet member and the axis of rotation are coordinated with the core-shooting head or its inlet opening, so as to permit the 360° rotation within the core-shooting head, and without contacting its walls. Consequently, it is possible to evenly distribute more or less the mold-core material or core sand to be shot or blown through the shooting nozzles by, for example, rotating the outlet member several times, so that the bulk density of the core sand forming in the core-shooting head is without, or exhibits only insignificant density gradients.

As regards the rotatability of the outlet member or storage hopper about the axis of rotation it is further advantageous to provide to this end preferably an electric drive motor. The latter could likewise be a so-called servomotor which is able to realize the movements very accurately within a millimeter and with any desired change of direction.

With regard to construction, the drive motor could be operatively connected via suitable mounting means and a turntable with the outlet member or the storage hopper. Thus, for example, the motor could engage via corresponding means in the outer portion of the turntable. Accordingly, the inner portion of the turntable would be fixedly connected with a mounting disk or the like.

In particular, from the viewpoint of saving floor space, the drive motor for rotating the outlet member and, possibly, the storage hopper, as well as the cylinder-piston arrangement for raising and lowering the outlet member or the storage hopper could be integrated to one structural assembly. In other words, the drive motor for rotating the outlet member would be arranged, for example, on the lower end of the cylinder-piston arrangement, i.e. it would be stationarily mounted on the exiting piston of the cylinder-piston arrangement, or its extension.

With respect to an exactly definable quantity of core sands to be filled into the core-shooting head, it will be of quite a special advantage to arrange the shutoff device at the discharge end of the outlet member. Such a configuration would allow to fill or store the core sands from the lower end of the outlet member up to the upper end of the storage hopper. Only upon opening the shutoff device, and after immersion into the core-shooting head, will the core sands enter into the latter, and preferably exclusively up to the depth of immersion of the outer end of the outlet member.

For a particularly simple and effective configuration of the shutoff device, same is constructed as a shutter which is adapted for rotation to the front of the discharge end of the outlet member and for sealing same at least to a great extent. The shutter lies thus approximately in a plane formed by the bottom edge of the outlet member, and can be rotated in this plane toward the discharge opening of the outlet member or away from the region of the discharge opening. In this arrangement, the outlet member and the shutter are dimensioned such that when the outlet member is immersed into the core-shooting head, the shutter can be rotated away, so that the discharge end is at least largely unobstructed or opened.

The axis of rotation of the shutter extends substantially parallel to the outlet member outside thereof. Within the scope of an advantageous development of the teaching in accordance with the invention, the axis of rotation of the outlet member and the axis of rotation of the shutter are substantially identical with respect to geometry, so that the shutter smoothing or leveling the filled core sand performs the same rotating motion as the outlet member, with this motion resulting in a smoothing or leveling of the core sand filled into the core-shooting head in almost the same plane.

Essential for the rotating motion of the shutter is that the latter can be secured in any desired rotated positions over the entire range of rotation. This means that it is possible to adjust the extent of opening of the outlet member, thereby influencing as a whole substantially the filling speed on the one hand and the quantity of the filling on the other.

With respect to the actuation of the shutter, it is particularly advantageous, when same is rotated by means of a cylinder-piston arrangement. For the transmission of force or the conversion of the linear movement of the cylinder-piston arrangement into a rotating or swing motion of the shutter, the cylinder-piston arrangement acts upon the shutter via a rocking lever and a guide rod rotatable by the rocking lever.

To prevent core sands in the storage hopper from adhering to less steep walls thereof as a result of adhesion, a vibration device is advantageously associated to the feed hopper, which causes the walls of the feed hopper to vibrate. When the outlet member is fixedly connected to the storage hopper, the vibratory motion will naturally also propagate to the outlet member, so that the core sands as a whole can be effortless transferred into the core-shooting head. Just because of the vibration device, it is however of further advantage to arrange between the storage hopper or outlet member and the machine frame, preferably between the storage hopper or outlet member and the turntable, at least one swing element for preventing vibrations from propagating to the machine frame. A vibration device could, for example, be an electric motor with an eccentric swivel or mass component.

The method of the present invention solves the foregoing problem by the following steps:

First, the outlet member and, in the event of a direct connection between the outlet member and storage hopper, also the storage hopper are moved to their idle position, i.e, to their upper position. This position ensures that the core-shooting head can be moved below the outlet member. In its idle position, the storage hopper is filled with core sand, with the shutter being closed. Consequently, it is possible to fill on the one hand the outlet member, and on the other hand the feed hopper up to its upper edge in accordance with the filling density of the core sand. Subsequently, the core shooting head is positioned below the outlet member. At this point, it should be noted that the positioning of the core-shooting head below the outlet member may also occur at an earlier time, for example, already prior to filling the storage hopper with core sand. It is only necessary to make sure that adequate space is available below the outlet member for positioning the core-shooting head.

In the following step, the outlet member is immersed into the core-shooting head, the depth of immersion being predetermined by the required filling of the core-shooting head with core sand. This filling depends again on the volume and the realizable density of the core to be shot. In its immersed condition, the outlet member is in its operating position. In the following, the shutter is opened at least in part for partially filling the core-shooting head to a predetermined height. As a result of the immersion depth, the filling occurs substantially up to the lower edge of the outlet member. If need arises, the outlet member will be closed by the shutter, the latter thereby leveling the filled core sand to some degree. Within the scope of the totally possible rotation or pivoting by 360°, the outlet member is moved to a further operating position with a predetermined depth of immersion, so that likewise the region adjacent to the previously filled position within the core-shooting head may be further filled. Thus, in a further position, the outlet member is reopened by the shutter, and the filling operation may repeat itself as desired in different positionings of the outlet member until the desired filling height is reached. Likewise, it is possible to pull the outlet member gradually upward during the filling of the core-shooting head, so as to permit to realize a predeterminable filling height, with as a whole, a lowest possible drop height of the core sand particles. Thus, there results within the core-shooting head only a certain bulk density of the core sands, but by no means a compacting corresponding to the knock density or even a greater density.

Furthermore, the filled core sand is leveled both by the rotating motion of the shutter and the swing motion of the outlet member itself. This allows to realize an accurate filling volume. A repeated rotation or filling makes it possible to realize any desired filling heights.

Finally, once the core-shooting head is adequately filled, the outlet member is closed by the shutter and removed from the core-shooting head to its idle position.

BRIEF DESCRIPTION OF THE DRAWINGS

Various possibilities exist to perfect and further develop the teaching of the present invention in advantageous manner. To this end reference may be made to the following description of an embodiment of the invention with reference to the drawing. In conjunction with the description of the preferred embodiment of the invention with reference to the drawing, also generally preferred embodiments and further developments of the teaching are described. In the drawing.

DETAILED DESCRIPTION OF THE DRAWINGS

Figure 1:
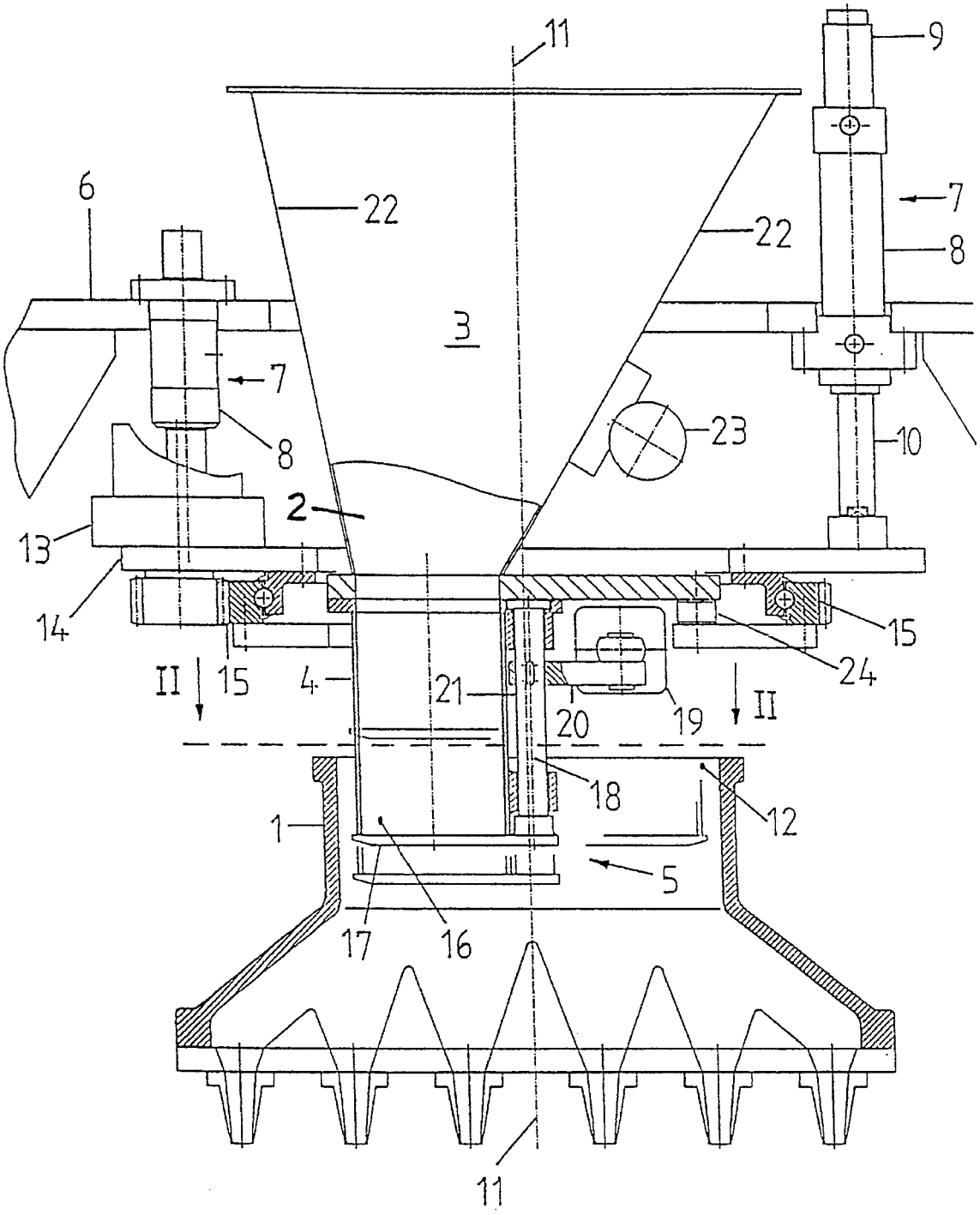
FIG. 1 is a schematic side view, cut, of an embodiment of a device in accordance with the invention for filling core-shooting heads with core sands, the device being shown in its operating position.

Illustrated in FIG. 1 is a sectional schematic view of a device for filling core-shooting heads 1 with mold-core materials, the latter being core sand in the here selected embodiment. Essential component parts of the device include a storage hopper 3 for core sand 2 shown generally at location, an outlet member or outlet pipe 4 for discharging core sand into core-shooting head 1, and a shutoff device 5 for closing outlet member 4.

In accordance with the invention, for purposes of immersing into core-shooting head 1 for filling, the outlet member 4 is mounted for vertical movement on a machine frame 6, and can be secured steplessly in any desired position within the range of its vertical mobility.

Figure 2:
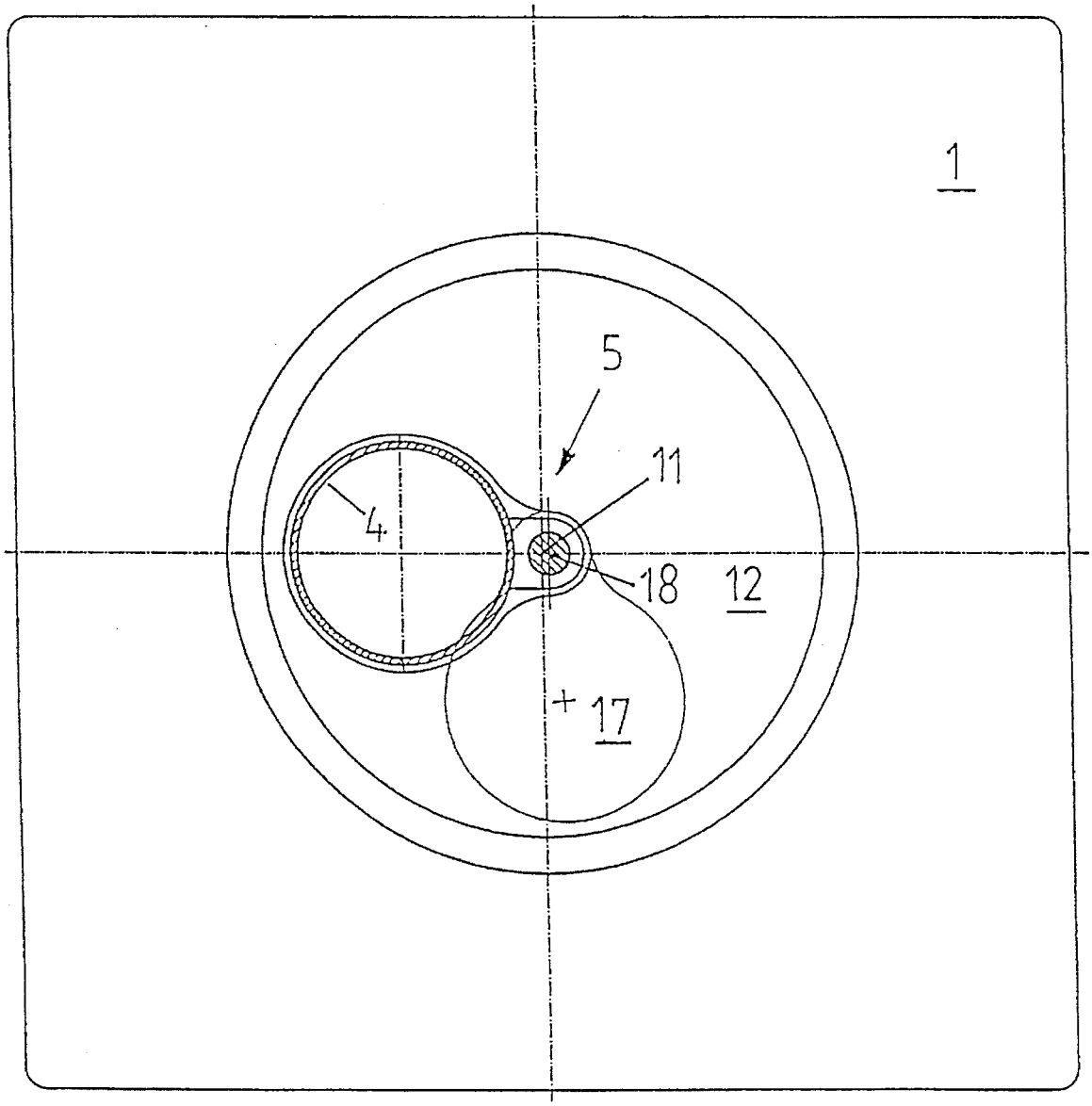
FIG. 2 is a sectional view of the device of FIG. 1 taken along line II—II.

FIG. 1 shows in combination with FIG. 2 that outlet member 4 is designed and constructed substantially tubular. The storage hopper 3 is made funnel-shaped. As is further clearly shown in FIG. 1, outlet member 4 directly adjoins storage hopper 3, so that outlet member 4 is held by storage hopper 3 and can be moved vertically together with the storage hopper 3.

The vertical mobility of outlet member 4 or of outlet member 4 together with storage hopper 3 occurs via a lifting mechanism 7 jointed to machine frame 6 and operative between machine frame 6 and outlet member 4 or storage hopper 3. In the here selected embodiment, lifting mechanism 7 comprises two drive mechanisms which serve simultaneously as vertical guideways. More specifically, they are cylinder-piston arrangements 8.

The vertical movement of outlet member 4 or storage hopper 3 can be detected by means of a noncontacting displacement measuring sensor 9. This displacement measuring sensor 9 detects the lifting motion of a piston be of cylinder piston arrangement 8 relative to machine frame 6. The displacement measuring sensor 9 may operate by induction, capacitance, or the eddy-current principle. Moreover, the measuring sensor may be a photo optic sensor. In the most preferred embodiment, though, an ultrasound sensor is utilized.

As can be noted from both FIG. 1 and FIG. 2, outlet member 4 and storage hopper 3 are endlessly rotatable as a whole about an axis of rotation 11, i.e. by 360° and more, in horizontal direction. The axis of rotation 11 extends in this arrangement parallel to outlet member 4 outside thereof. As can be noted from FIG. 2, the outlet member 4 and axis of rotation 11 are adapted to core-shooting head 1 or its inlet opening 12 so as to permit without any problem the 360° rotation within core-shooting head 1.

As regards the rotating movement of outlet member 4 or storage hopper 3 it is essential that outlet member 4 be rotated together with storage hopper 3 by means of an electric drive motor 13. The latter is only schematically indicated in FIG. 1. The drive motor 13 is operatively connected via corresponding mounting means 14 and a turntable 15 with outlet member 4 or storage hopper 3. As is further shown in FIG. 1, drive motor 13 for rotating outlet member 4 or storage hopper 3 and cylinder-piston arrangement 8 for raising and lowering outlet member 4 are integrated to one structural assembly. Further clearly shown in FIG. 1 is that shutoff device 5 is arranged at discharge end 16 of outlet member 4. More specifically, shutoff device 5 is designed and constructed as a shutter 17 adapted for rotation to the front of discharge end 16 of outlet member 4 and for largely sealing same. The shutter 17 may be secured to prevent rotation when a desired position is obtained. Outlet member 4 and shutter 17, as illustrated in FIG. 2, are dimensioned such as to permit shutter 17 to rotate away, when outlet member 4 is immersed into core-shooting head 1, so that outlet end 16 is entirely uncovered.

Both FIG. 1 and FIG. 2 show that shutter 17 is rotatable about an axis of rotation extending substantially parallel to outlet member 4. Both figures show that the axis of rotation 11 of outlet member 4 and the axis of rotation 18 of shutter 17 are geometrically about identical. Furthermore, it is essential that over the entire range of rotation shutter 17 can be secured in any desired rotated positions, the illustration selected in FIG. 2 indicating two rotated positions.

As is further indicated in FIG. 1, shutter 17 is rotated by means of a cylinder-piston arrangement 19. This cylinder-piston arrangement 19 is operatively connected via a rocking lever 20 and a guide rod 21 with shutter 17. Thus, it is possible to convert the linear movement of cylinder-piston arrangement 19—via rocking lever 20 and guide rod 21—into a rotating movement of shutter 17.

As is still further shown in FIG. 1, associated to storage hopper 3 is a vibration device 23 for vibrating a wall 22 of storage hopper 3. In order to avoid that the vibration serving to shake the core sand into outlet member 4 propagates to machine frame 6, a swing element 24 installed between outlet member 4 or storage hopper 3 and turntable 15 is provided for preventing vibrations from propagating to machine frame 6.

Finally, at this point, it should merely be mentioned that for an exact determination of the quantity to be filled into core-shooting head 1, storage hopper 3 and outlet member 4 may be provided with a weighing device. The latter would determine in a particularly advantageous manner the weight difference between the empty storage hopper or empty outlet member and the storage hopper or outlet member filled with core sand. Likewise, it would be possible to monitor, via a weight loss, the filling the core-shooting head, it being possible to predetermine in effortless manner the desired filling level via the weight and with known density or bulk density.

As regards the method of the present invention, reference may be made to the description in the general portion of the specification.

In summary, it should be emphasized that the gist of the present invention—accurate adjustment of the filling quantity of mold-core material required for making a core with an approximately even distribution of the mold-core material inside the core-shooting head—may be realized also with other filling devices or core-shooting heads. The foregoing embodiment merely described by way of example serves only for an understanding of the teaching of the present invention, but is not limited thereto.

That which is claimed is:

1. A device for filling core shooting head with mold core material comprising:

a storage hopper for retaining the mold core material;

an outlet member connected to said hopper for discharging the mold core material from the hopper and outlet member into the core shooting head when said outlet member is inserted into the core shooting head;

means mounting said outlet member on a machine frame so as to be vertically adjustable and permit said outlet member to be selectively positioned and secured in various vertical positions within said core shooting head; and a shutoff device for selectively opening and closing said outlet member.

2. A device according to claim 1, wherein said outlet member is substantially tubular.

3. A device according to claim 1, wherein said storage hopper is substantially funnel shaped.

4. A device according to claim 1, wherein said outlet member is integral with said storage hopper so that said hopper and outlet member are simultaneously vertically adjustable.

5. A device according to claim 1, wherein said mounting means comprises at least one drive mechanism for selectively raising and lowering said outlet member.

6. A device according to claim 5, wherein said drive mechanism comprises a cylinder and a piston.

7. A device according to claim 1, further comprising a non-contacting displacement measuring sensor for detecting the vertical position of said outlet member.

8. A device according to claim 7, wherein said displacement measuring sensor detects the position of said mounting means and determines its relative position to said machine frame.

9. A device according to claim 1, wherein said outlet member is rotatable about a substantially vertical axis which extends substantially parallel to and outside of said outlet member.

10. A device according to claim 9, wherein said outlet member is rotatable about said vertical axis.

11. A device according to claim 9, further comprising an electric drive motor for rotating said outlet member about said vertical axis.

12. A device according to claim 11, further comprising a turntable operatively connecting said drive motor to said outlet member.

13. A device according to claim 11, wherein said mounting means comprises a drive mechanism for selectively raising and lowering said outlet member, and wherein said drive motor for rotating said outlet member and said drive mechanism are connected to a common mounting member.

14. A device according to claim 1, wherein said shutoff device is positioned at an outlet end of said outlet member.

15. A device according to claim 14, wherein said shutoff device comprises a rotating shutter so that said shutter may be rotated to close said outlet end of said outlet member and wherein said outlet member and said shutter are dimensioned to permit said shutter to rotate away from said outlet end when said outlet end is inserted in the core shooting head so that said outlet end is opened.

16. A device according to claim 15, wherein said outlet member is tubular and defines a central axis, and wherein said shutter rotates about an axis extending substantially parallel to said central axis of said outlet member.

17. A device according to claim 16, further comprising a cylinder-piston arrangement associated with said shutter for rotating said shutter about its axis of rotation.

18. A device according to claim 17, wherein said cylinder-piston arrangement is connected on a rocking lever and a guide rod which are in turn connected to said shutter.

19. A device according to claim 1, further comprising a vibration device mounted to said storage hopper for imparting vibrations to the exterior surface of said storage hopper.

20. A device according to claim 19, wherein said storage hopper is rigidly connected to said outlet member, and said device further comprises a vibration dampening element positioned between said outlet member and said machine frame to prevent vibrations from propagating to said machine frame.

21. A device for filling a core shooting head with mold core material comprising:

a storage hopper for retaining the mold core material;

an outlet member defining a central vertical axis and connected to said hopper for discharging the mold core material from the hopper and outlet member into the core shooting head when the outlet member is inserted into the core shooting head;

means mounting said outlet member on a vertically adjustable machine frame so as to permit said outlet member to be selectively positioned and secured in various vertical positions within the core shooting head, and so as to permit rotation of said outlet member about a second vertical axis which is laterally offset from the central vertical axis of said outlet member;

drive means for selectively raising and lowering said outlet member and for selectively rotating said outlet member about said second vertical axis; and a shutoff device for selectively opening and closing said outlet member.

22. A device according to claim 21, wherein said shutoff device comprises a shutter, and means rotatably mounting said shutter about a further axis which is parallel to said second vertical axis and for movement between a first position closing the outlet member and a second position at least partially withdrawn from the outlet member.

23. A device according to claim 21, further comprising a vibration device mounted to one of said storage hopper and outlet member for imparting vibrations thereto so as to facilitate the discharge of the mold core materials into the core shooting head.

24. A method of filling core shooting heads with mold core material comprising the steps of:

providing a device for filling core shooting heads with mold core material comprising a storage hopper for retaining the mold core material, an outlet member associated with said hopper for discharging the mold core material into the core shooting head, and a rotatable shutter which closes an outlet end of said outlet member;

filling said storage hopper with the mold core material while said shutter is closed;

positioning the outlet member above the core shooting head;

immersing said outlet member into the core shooting head wherein said outlet member is immersed a predetermined distance depending upon a desired filling height;

opening said shutter so as to at least partially fill the core shooting head to said predetermined filling height;

closing said outlet member by rotating said shutter; and retracting said outlet member to an idle position.

25. The method as defined in claim 24, wherein the outlet member is tubular and defines a central axis, and comprising, prior to the retracting step, the further subsequent steps of rotating the outlet member about a vertical axis which is parallel to and offset from said central axis; and reopening said shutter so as to further fill the core shooting head.

26. The method as defined in claim 25 comprising, prior to the retracting step, the further step of partially raising the outlet member during at least one of the filling steps or between the two filling steps.

27. The method as defined in claim 24, wherein the step of rotating the shutter to close the shutter serves to smooth the filled-in mold core material.

* * * * *